US006435089B1

(12) United States Patent
Castro Netto et al.

(10) Patent No.: US 6,435,089 B1
(45) Date of Patent: Aug. 20, 2002

(54) MANUAL IMPRINTER FOR TRANSFERRING THE IMAGE OF A RELIEF FORMATION TO A WRITING SURFACE

(76) Inventors: Eduardo De Lima Castro Netto, deceased, late of Rio de Janeiro; by Lydia de Faria Lima Castro, executrix, Rua Othon Bezerra de Mello, 40, Rio de Janeiro, both of (BR)

( * ) Notice: Subject to any disclaimer, the term of this patent is extended or adjusted under 35 U.S.C. 154(b) by 0 days.

(21) Appl. No.: 09/672,027

(22) Filed: Sep. 29, 2000

(30) Foreign Application Priority Data

Oct. 11, 1999 (BR) ..... 9905094

(51) Int. Cl.[7] ..... B41F 3/04
(52) U.S. Cl. ..... 101/269; 101/3.1; 101/45
(58) Field of Search ..... 101/3.1, 4, 5, 45, 101/269, 272, 405, 492; 400/127, 129, 132, 134.4, 147, 170, 174, 175

(56) References Cited

U.S. PATENT DOCUMENTS 3,508,488 A * 4/1970 Maul et al. ..... 101/45
3,735,701 A * 5/1973 Ackerman ..... 101/269
3,983,802 A * 10/1976 Thomson et al. ..... 101/45
4,027,589 A * 6/1977 Timm ..... 101/269
4,227,453 A * 10/1980 McInnis ..... 101/45
4,341,951 A * 7/1982 Benton ..... 235/379
5,189,953 A * 3/1993 Kennedy et al. ..... 101/269

* cited by examiner

*Primary Examiner*—Andrew H. Hirshfeld
*Assistant Examiner*—Kevin D. Williams
(74) *Attorney, Agent, or Firm*—Smith, Gambrell & Russell, LLP

(57) ABSTRACT

A manual imprinter for transferring the image of a relief formation to a writing surface, preferably to imprint a document with the number of a security seal personalized by a relief numbering. The manual imprinter, in the presently preferred embodiment, comprises a support art adapted to support the numbered portion of the security seal, and an arm carrying a graphite block, hinged to the arm. The arm has a guide for a manual actuator, to which the graphite block is fixed. When the arm is closed against the arm, the block is pressed against the numbered portion of the security seal, the document to be imprinted being interposed therebetween. The operation of the actuator forces the graphite block across the region of the relief number of the seal, resulting in the transfer of the image of the number to the document.

10 Claims, 1 Drawing Sheet

FIG. 1
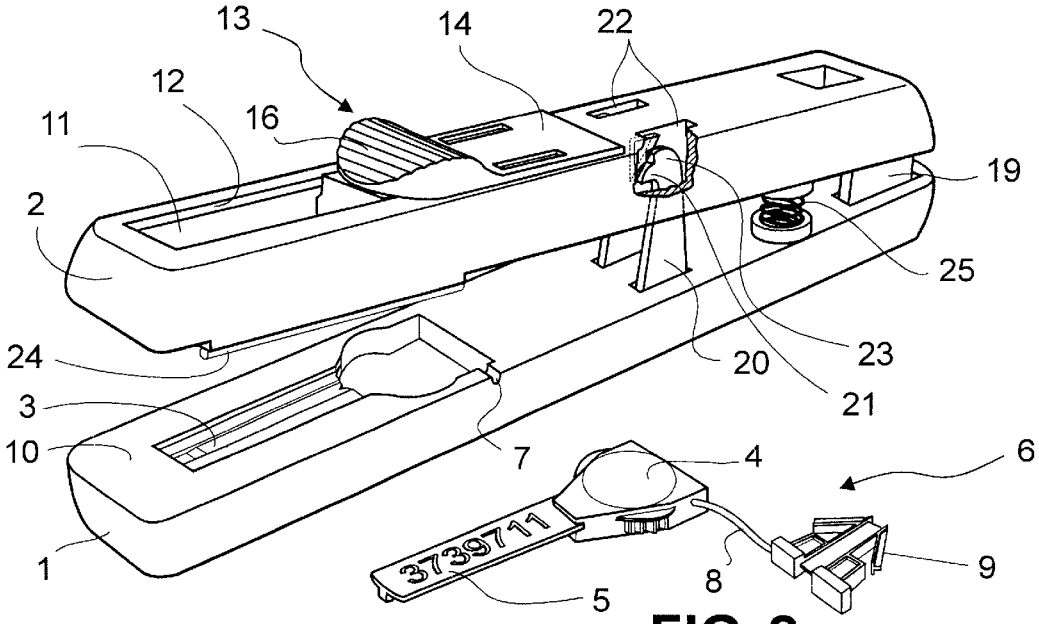
FIG. 2
FIG. 3
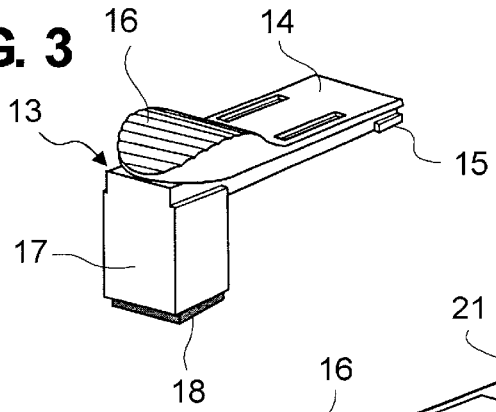
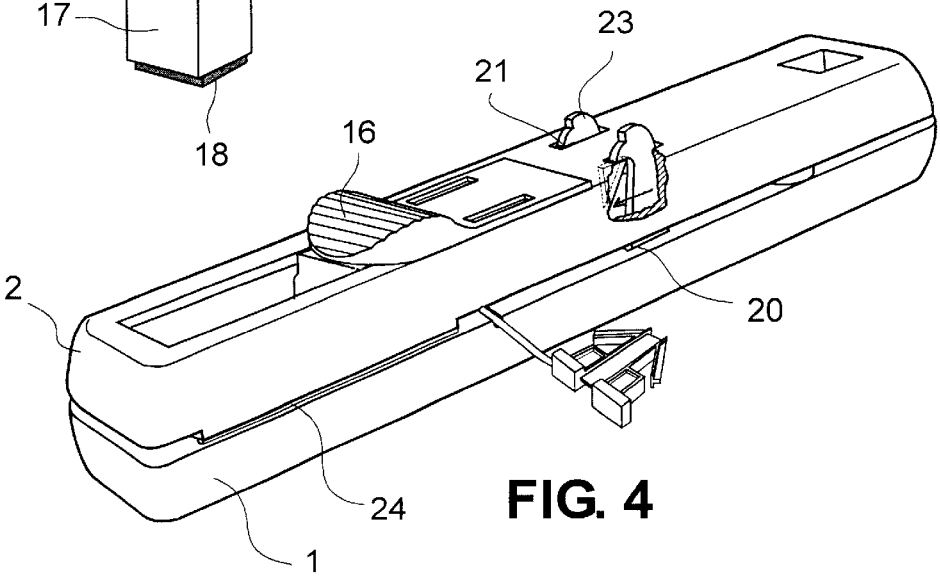
FIG. 4

MANUAL IMPRINTER FOR TRANSFERRING THE IMAGE OF A RELIEF FORMATION TO A WRITING SURFACE

The present invention refers to a manual imprinter designed for transferring the image of a relief formation onto a writing surface, to maintain a register of that formation. More particularly, it refers to a device capable of registering on paper, for example, an invoice or a shipping document, the number of a security seal identified by a number or code formed in relief on a surface of the seal.

PRIOR ART

Security seals are often individualized by numbers of their own, in order to prevent their unauthorized replacement with another similar seal. For security, the numbering should be created in high relief at the time of manufacturing the seal, since this will effectively prevent unauthorized people from applying the specific number in high relief to another similar seal. Evidently the use of a numbered seal can only be of help if the number is registered in such a way that the identity between the numbers can be checked at a later time, for example, when receiving a bag containing valuables or the like. Thus, the person responsible for sending a sealed bag, for example, needs to write down the number of the seal on an invoice or shipping document. This is not only laboursome, but also leads to mistakes.

OBJECT OF THE INVENTION

The general object of the present invention is to provide a simple device that will enable one to transfer the image of a relief formation to a writing surface. More specifically, the device enables one to transfer the number in relief formed on a security seal to paper.

BRIEF DESCRIPTION OF THE INVENTION

According to the present invention a manual imprinter for transferring the image of a relief formation onto a writing surface, comprises:

- an elongated base support arm having a first end and a second end;
- a substantially planar surface region adjacent said first end of said support arm;
- a cavity formed in said planar surface region and adapted to receive an element having a relief formation, said relief formation projecting from said planar surface region when said element is received in the cavity,
- an elongated imprinter arm having a first end and a second end, said imprinting arm being of substantially the same length as said support arm and being hinged at its second end to said second end of said support arm so as to be able to be hinged from an open position in which said first ends are remote from each other to a second imprinting position in which to said first ends are proximate to one another;
- elastic buffer means on one said arms and positioned to be facing the other of said arms adjacent the first ends thereof, whereby in said imprinting position said buffer means prevent contact between said arms when manually squeezed against each other; and
- an imprinter means supported on said imprinter arm and arranged for linear longitudinal alternate sliding movement therealong; and
- a manual actuator associated with said imprinting means to permit a user to use his thumb to cause said alternate sliding movement of said imprinter means;

said imprinter means including a material writing-material transfer element in the form of a block of said writing material, capable of transferring, under pressure, said writing material to a writing surface positioned between said arms in the imprinting position.

In order to facilitate the use of the device and to ensure a good print of the seal number on the surface of a sheet of paper inserted between the two arms, there is a locking device for releasably locking the imprinter member in the imprinting position.

BRIEF DESCRIPTION OF THE DRAWINGS

The invention will be better understood from the following description, given by way of example, reference being made to the accompanying drawings, in which:

FIG. 1 is a perspective view of a portable manual imprinter according to a presently preferred embodiment of this invention, the manual imprinter being in the open position;

FIG. 2 is a perspective view of a security seal numbered in high relief, with which the manual imprinter of FIG. 1 will be used;

FIG. 3 is a perspective view of the actuator and of the transfer element of the manual imprinter; and FIG. 4 is a perspective view similar to that of FIG. 1, but with the manual imprinter in the closed or imprinting position.

DETAILED DESCRIPTION OF THE DRAWINGS

With reference to the drawings, a portable manual imprinter according to an embodiment of the invention comprises two arms 1 and 2 hinged with respect to each other at one end. Arm 1 is a support having a cavity 3 adjacent the distal end in relation to the hinge point, the cavity having a shape suitable for receiving the capsule 4 and the numbered tab 5 of a security seal 6. There is also a groove 7 in communication with cavity 3 for receiving a thread 8 connecting capsule 4 of the seal with its insertion lock 9. The depth of cavity 3 is such that, when tab 5 of the seal is fitted therein, its upper surface lies substantially flush with the upper surface 10 of arm 1, but with the portion in relief, that is, the number, upstanding from such surface.

The upper arm 2 of the manual imprinter is formed with an opening 11 that is elongated in the longitudinal direction in a region above the cavity 3 in lower arm 1. The upper edge of each longitudinal side of the opening 11 projects slightly inwards, to define a guide rail 12 that serves as a guide for an actuator 13, better seen in FIG. 3. Actuator 13 comprises an elongated plate 14 with short side projections 15 defining with plate 14 side grooves for cooperation with the rails 12. The actuator is further formed with a curved protuberance 16 that enables the user of the imprinter to utilize his thumb to impel the actuator forwards and backwards along rails 12.

The actuator 13 further comprises a tube 17 of square cross-section projecting downwards through opening 11. Tube 17 contains a block 18 of material capable of transferring an image to paper, for example, graphite. This block 18 may be similar to the collector mounted on the stator of an electric motor or alternator, but with a plane contact end. The exposed surface of block 18, in the closed or imprinting position of the imprinter, remains substantially on the plane of the relief number, formed on tab 5 of the security seal.

Along the two opposite longitudinal sides of opening 11, on the lower surface of arm 2, there is a pair of soft elements or pads 24, only one of which is visible in FIG. 1. In the illustrated embodiment of the invention, elements 24 comprise extensions of a small diameter plastic tube, received in small grooves opened in the lower surface of arm 2. However, any other soft and slightly elastic material may be used for the elements 24, for example, extensions of soft rubber adhered or otherwise fixed to the lower surface of arm 2.

It can also be seen that the small guiding projections 15 are formed at the end of the actuator remote from the actuating protuberance 16. This allows the block-carrying end to have some freedom of movement also in the vertical direction, to accommodate the differences of level of the relief number on the tab of the seal during the imprinting movement.

The articulation between the two arms 1 and 2 is effected by means of a pair of short rigid arms 19 (only one is visible in the drawings), integral at their ends with arm 2, perpendicularly to the latter. Each arm 19 is pivoted at its lower end on the arm 1. Two springs 25 (only one is visible in the drawings) bias the two arms 1 and 2 towards the open position of the manual imprinter, shown in FIG. 1.

There is also a locking element, vertically mounted on the arm 1 through a bias spring (the bias spring biasing the locking element into a locking state as represented by the arrow in FIG. 4). The locking element comprises two small parallel arms 20 that are vertically oriented and laterally spaced-apart from each other. Each arm 20 is formed with a tooth 21 at its upper end. Upper arm 2 of the device is formed with two small openings 22 to receive the teeth 21 in locking relationship, biased in the locking direction by the biasing spring (not shown). The upper end of each small arm 20 is further formed with a protrusion 23 that stands out of the arm 2 of the device in the imprinting position shown in FIG. 4.

When the two arms 1 and 2 of the imprinter are manually pressed into the closed or imprinting (stamping) position, the block 17 approaches the arm 1 until pads 24 contact surface 10 of arm 1, thus creating an elastic resistance. In this position, the locking teeth 21 enter into locking relationship with the front edges of openings 22, locking the imprinter in the closed position. The arrangement of protrusions 23, however, is such that, when manually displaced backwards by the user, the claws 21 are automatically released and the imprinter can return to its open configuration shown in FIG. 1, aided by the springs 18.

Upon using the device, the numbered tab 5 and the capsule 4 of the security seal 6 are fitted into the cavity 3 in the arm 1 of the manual imprinter. The document, for example, a sales note, to be imprinted with the seal number is then inserted between arms 1 and 2 so as to cover tab 5. The arms 1 and 2 are then manually squeezed together to close the imprinter onto the document that is clamped against the tab 5 when the teeth 21 enter into locking relationship with the edges of openings 22. In this position (FIG. 4), the graphite block 18 is pressed against the document, which in turn is pressed against the relief number on tab 5. The user then applies his thumb against the protuberance 16 to displace the actuator 13 forwards and then backwards again to its starting position. This displaces the graphite block 18 across the surface of the document, forcing it against the relief formation of the number on the seal plate, thus creating on the document a perfect image of the number, without smudging or shadows.

The perfection of the printed image is due, in large part, to the fact that, at the time of locking the manual imprinter in the closed position, the document is clamped, being pressed by the elements or pads 24, so that it will be totally stationary when the actuator is displaced forward and backward. This aspect is extremely important in practice.

Finally, the user has only to draw back the small protrusions 23 to release the teeth 22 and thereby unlock the imprinter, which automatically returns to its open position (FIG. 1). The document and the seal are then withdrawn, and the seal is used to seal a bag or another product to be sealed.

It will be understood that the manual imprinter shown in the drawings and described in detail above serves only to exemplify the present invention. A number of variations are evidently possible, without departing from the spirit and the true scope of the invention. For example, if many bags have to be closed and sealed in a single location, it may be convenient to manufacture the imprinter fixed on a bench. (In this case, the support arm 1 of the stamp could be replaced by a plate fixed to the bench, this plate being adequately shaped to receive the numbered or otherwise personalized portion of a seal. An element equivalent to the arm 2 could be either hinged to the support plate or directly pivoted on the bench.) The important feature is that the device can easily be closed over the support and that a simple mechanism can be provided to displace an image-transferring material, under pressure, over the relief surface of the seal, with a document sandwiched therebetween. Therefore, the true scope of this invention is only limited by the definitions contained in the accompanying claims.

We claim:

1. A manual imprinter for transferring the image of a relief formation onto a writing surface, comprising:

an elongated base support arm having a first end and a second end;

a substantially planar surface region adjacent said first end of said support arm;

a cavity formed in said planar surface region and adapted to receive an element having a relief formation, the relief formation projecting from said planar surface region when the element is received in the cavity, an elongated imprinter arm having a first end and a second end, said imprinting arm being of substantially the same length as said support arm and being hinged at its second end to said second end of said support arm so as to be able to be hinged from an open position in which said first ends are remote from each other to a second imprinting position in which said first ends are proximate to one another;

elastic buffer means on one of said arms and positioned to be facing the other of said arms adjacent the first ends thereof, whereby in said imprinting position said buffer means prevents contact between said arms when manually squeezed against each other; and an imprinter means supported on said imprinter arm and arranged for linear longitudinal alternate sliding movement therealong; and a manual actuator associated with said imprinting means to permit a user to use his thumb to cause said alternate sliding movement of said imprinter means; said imprinter means including a material writing-material transfer element in the form of a block of writing material, capable of transferring, under pressure, said writing material to a writing surface positioned between said arms in the imprinting position.

2. The manual imprinter according to claim 1, further comprising locking means for releasably locking said arms in the imprinting position, so as to firmly clamp against sliding, a sheet of paper to be imprinted, placed between the support arm and the imprinter arm, said elastic buffer means squeezing said sheet of paper against said other of said arms.

3. The manual imprinter according to claim 2, in which said elastic buffer means is fixed to said imprinting arm on a surface thereof facing said planar surface region of said support arm.

4. The manual imprinter according to claim 1, in which the writing material comprises graphite.

5. The manual imprinter according to claim 2, wherein said locking means comprising a locking element mounted on said support arm, said locking element having a free end with a lock that can cooperate with a formation on said imprinter arm when the latter is in said imprinting position.

6. The manual imprinter according to claim 5, wherein the locking element is spring biased in the direction of a locked position.

7. The manual imprinter according to claim 6, in which said lock is provided with a projection that projects, in said locked position, through an opening in said imprinting arm, said projection being manually manipulable against said spring bias to liberate said lock from said formation whereby said imprinter can revert to said open position.

8. The manual imprinter according to claim 3, further including locking means comprising a locking element mounted on said support arm, said locking element having a free end with a lock that can cooperate with a formation on said imprinter arm when the latter is in said imprinting position.

9. The manual imprinter according to claim 8, wherein the locking element is spring biased in the direction of a locked position.

10. A manual imprinter according to claim 9, in which said lock is provided with a projection that projects, in said locked position, through an opening in said imprinting arm, said projection being manually manipulable against said spring bias to liberate said lock from said formation whereby said imprinter can revert to said open position.

* * * * *